US006986409B2

(12) United States Patent
Birbaumer

(10) Patent No.: US 6,986,409 B2
(45) Date of Patent: Jan. 17, 2006

(54) APPARATUS FOR DETERMINING THE POSITION OF AN ELEVATOR CAR

(75) Inventor: Hugo Birbaumer, Neuheim (CH)

(73) Assignee: Bucher Hydraulics AG, Neuheim (CH)

( * ) Notice: Subject to any disclaimer, the term of this patent is extended or adjusted under 35 U.S.C. 154(b) by 10 days.

(21) Appl. No.: 10/473,526

(22) PCT Filed: Jan. 21, 2003

(86) PCT No.: PCT/CH03/00039

§ 371 (c)(1),
(2), (4) Date: Sep. 30, 2003

(87) PCT Pub. No.: WO03/066496

PCT Pub. Date: Aug. 14, 2003

(65) Prior Publication Data

US 2004/0094368 A1 May 20, 2004

(30) Foreign Application Priority Data

Feb. 2, 2002 (CH) ..... 0173/02

(51) Int. Cl.
*B66B 1/34* (2006.01)

(52) U.S. Cl. ..... 187/394

(58) Field of Classification Search ..... 187/391–394, 187/497, 397

See application file for complete search history.

(56) References Cited

U.S. PATENT DOCUMENTS

| | | | | | |
|---|---|---|---|---|---|
| 3,781,901 | A | * | 12/1973 | Morrison | 346/33 R |
| 4,083,430 | A | * | 4/1978 | Gingrich | 187/394 |
| 4,427,095 | A | | 1/1984 | Payne et al. | |
| 4,436,185 | A | * | 3/1984 | Ludwig et al. | 187/247 |
| 4,750,592 | A | * | 6/1988 | Watt | 187/394 |
| 5,594,219 | A | * | 1/1997 | Kamani et al. | 187/394 |
| 6,128,116 | A | * | 10/2000 | Dobler et al. | 398/106 |
| 6,142,259 | A | | 11/2000 | Veletovac et al. | |
| 6,327,791 | B1 | * | 12/2001 | Norcross et al. | 33/706 |
| 6,435,315 | B1 | * | 8/2002 | Zaharia | 187/394 |
| 6,510,923 | B1 | | 1/2003 | Veletovac et al. | |
| 6,622,827 | B1 | * | 9/2003 | Disieno | 187/394 |
| 2001/0013307 | A1 | * | 8/2001 | Stone | 108/147 |
| 2002/0112926 | A1 | * | 8/2002 | Siberhorn | 187/394 |
| 2003/0070883 | A1 | * | 4/2003 | Foster et al. | 187/394 |
| 2004/0195048 | A1 | * | 10/2004 | Schonauer et al. | 187/394 |

FOREIGN PATENT DOCUMENTS

| | | | |
|---|---|---|---|
| EP | 1 158 310 | | 6/2000 |
| JP | 05039178 A | * | 2/1993 |

* cited by examiner

*Primary Examiner*—Jonathan Salata
(74) *Attorney, Agent, or Firm*—Cohen, Pontani, Lieberman & Pavane

(57) ABSTRACT

Apparatus for determining the position of an elevator car in an elevator shaft includes a resistance wire installed vertically in the elevator shaft, the wire having a first end supplied with an operating voltage and a second end supplied with a reference voltage; a voltage tap installed on the elevator car, the voltage tap having a contact which rides on the resistance wire between the ends; and a position sensing unit connected to the voltage tap by a measuring line.

8 Claims, 4 Drawing Sheets

APPARATUS FOR DETERMINING THE POSITION OF AN ELEVATOR CAR

PRIORITY CLAIM

This is a U.S. national stage of application No. PCT/CH03/00039, filed on 21 Jan. 2003. Priority is claimed on that application and on the following application: Country: Switzerland, Application No.: 173/02, Filed: 2 Feb. 2002.

BACKGROUND OF THE INVENTION

1. Field of the Invention

The invention concerns a device for determining the position of an elevator car, including a device permanently installed in the elevator shaft which is at least as long as the total travel of the car between its uppermost and lowermost stop positions, and an additional device installed on the elevator car.

Devices of this type are used in elevator systems of various kinds. In these elevator systems, an elevator car is moved vertically between the floors of a building, and it is necessary to know the present position of the elevator car. Switching devices installed in the elevator shaft have a role in this.

2. Description of the Related Art

U.S. Pat. No. 4,427,095 describes a device for determining the position of an elevator car, in which a coded tape is scanned by a tape reader. Each position of the elevator car corresponds to a certain code value, which is evaluated by a microprocessor.

U.S. Pat. No. 6,142,259 describes a device for controlling a hydraulic elevator, in which an automatic control system for the elevator receives information about changes in the position of the elevator car by elevator shaft pulse generators. However, the travel of the elevator car is also monitored by a flowmeter, which makes it possible to regulate the speed.

U.S. Pat. No. 6,510,923 describes a device for controlling a hydraulic elevator, in which a flowmeter is not used. Instead, a pressure sensor installed in this line determines the pressure in the cylinder line. The change in pressure with respect to time is evaluated, and it is also stated that the acceleration of the elevator car can be computed from the pressure. From this information, it is then supposed to be possible to derive the speed of the elevator car and the distance it has traveled. It seems questionable whether the accuracy of the pressure sensors is great enough to allow sufficiently exact control of an elevator from the change in pressure as a function of time and from repeated differentiation of this data.

EP-A1-1 158 310 describes a device for determining the position of an elevator car, in which a sonic signal conductor is installed in the elevator shaft, and a signal coupler is installed on the elevator car. The sonic signal is in the ultrasonic range. The sonic signal conductor consists of a magnetostrictive metallic material. This system requires a transmitting unit with a signal generator and the aforementioned signal coupler, as well as at least one signal receiver and one evaluation unit.

SUMMARY OF THE INVENTION

The objective of the invention is to create a device that has a simple design and yields sufficiently exact information about the position and movement of the elevator car.

In accordance with the invention, this objective is achieved by the features of Claim 1. Advantageous modifications are specified in the dependent claims.

DETAILED DESCRIPTION OF THE PRESENTLY PREFERRED EMBODIMENTS

Figure 1:
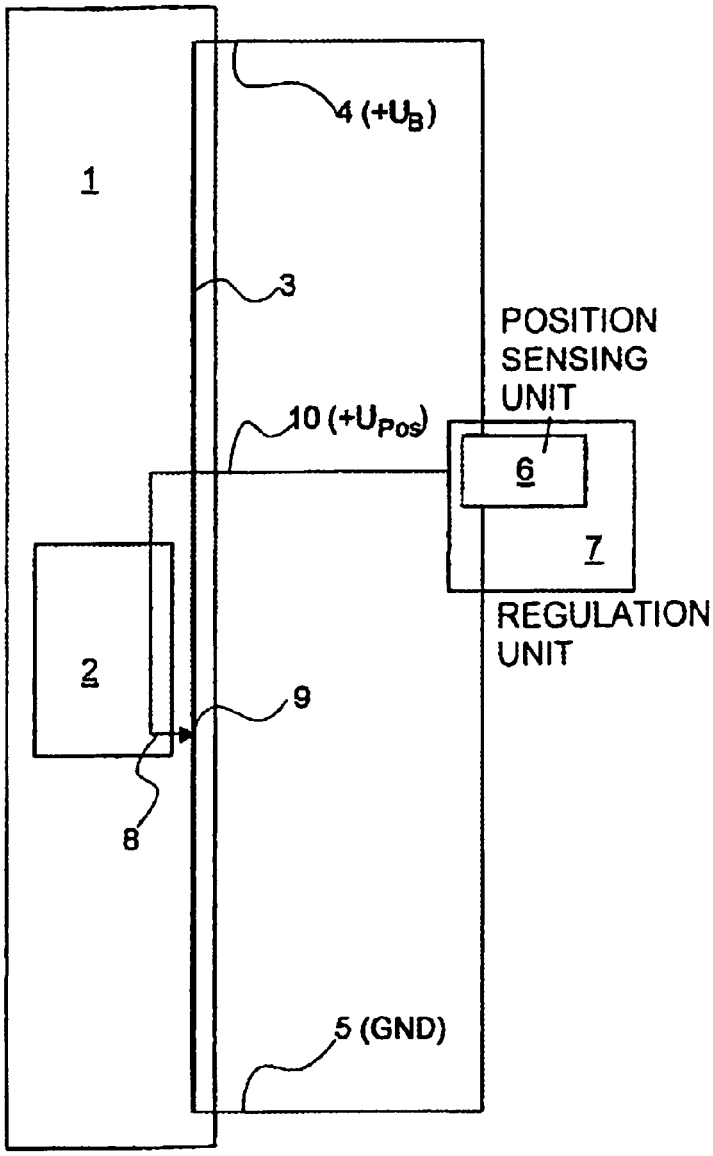
FIG. 1 shows a diagram of a device for determining the position of an elevator car.

FIG. 1 shows an elevator shaft 1, in which an elevator car 2 can be moved in the vertical direction. In accordance with the invention, a resistance wire 3 is installed in the elevator shaft 1 and is arranged in the vertical direction, i.e., in the direction of movement of the elevator car 2. A first electric connecting lead 4 is connected at the upper end of this resistance wire 3, and a second electric connecting lead 5 is connected at the lower end of the resistance wire 3. The two electric connecting leads 4, 5 are routed to a position-sensing unit 6, which is part of the automatic control and regulation unit 7. The first electric connecting lead 4 carries an operating voltage+$U_B$ as a signal, while the second electric connecting lead 5 carries the associated reference voltage GND. A voltage tap 8 is connected to the elevator car 2, and the contact 9 of the voltage tap 8 rests against the resistance wire 3. During the operation of the elevator car 2, the contact 9 slides along the resistance wire 3. A measuring line 10 runs from the contact 9 of the voltage tap 8 to the position-sensing unit 6.

The resistance wire 3 is thus permanently installed in the vertical direction in the elevator shaft 1 and is at least as long as the total travel distance of the elevator car 2 between its lowermost and uppermost stop positions.

Accordingly, if the voltage +$U_B$, for example, 10 V, is applied at one end of the resistance wire 3, and the voltage 0 V, which represents the reference voltage GND, is applied at the other end of the resistance wire 3, then the voltage present at the contact 9 and thus at the measuring line 10 is a direct function of the position of the elevator car 2. The given position of the elevator car 2 can thus be clearly recognized by the position-sensing unit 6. The voltage $U_{Pos}$, carried by the measuring line 10 is a direct function of the position of the elevator car 2:

$$U_{Pos}=f(Pos_{car}),$$

where $Pos_{car}$ denotes the given position of the elevator car 2.

Thus, the velocity of the elevator car 2 can also be determined from the change in $U_{Pos}$ with respect to time:

$$v=dU_{Pos}/dt \text{ or } v=\Delta U_{Pos}/\Delta t$$

where v is the velocity of the elevator car 2 and $dU_{Pos}/dt$ or $\Delta U_{Pos}/\Delta t$ is the derivative of the voltage $U_{Pos}$ with respect to time.

The equipment for guiding and driving the elevator car 2 are not shown here, because they play no role at all with respect to the invention. The invention can be used in both electrically and hydraulically operated elevators, and the specific embodiment is of no consequence.

Figure 2:
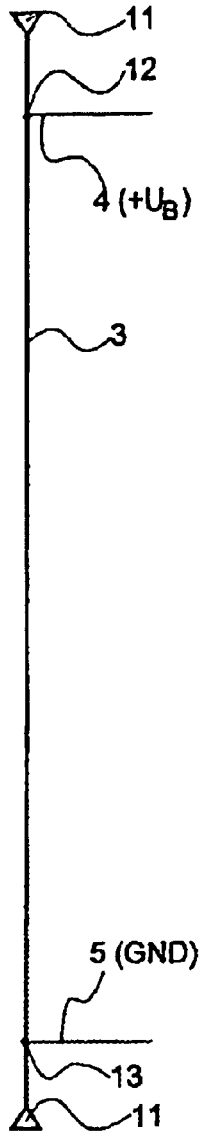
FIG. 2 shows an advantageous embodiment.

FIG. 2 shows an advantageous embodiment. The resistance wire 3 is mounted in the elevator shaft 1 (FIG. 1) by one mounting device 11 each at the top and bottom, either on a sidewall of the elevator shaft 1 or on the roof and floor of the elevator shaft 1. The first electric connecting lead 4 is connected to the resistance wire 3 at an upper reference point 12, which is correlated with the uppermost position of the elevator car 2 (FIG. 1). The second electric connecting lead 5 is similarly connected to the resistance wire 3 at a lower reference point 13, which is correlated with the lowermost position of the elevator car 2 (FIG. 1). In this way, the uppermost and lowermost positions of the elevator car 2 are determined by unique voltages. If the elevator car 2 is located in the uppermost position, then the voltage $+U_B$, i.e., for example, 10 V, is present at the measuring line 10 (FIG. 1). If the elevator car 2 is located in the lowermost position, then the voltage 0 V is present at the measuring line 10.

In an elevator system with four stop positions spaced an equal distance apart, a voltage $U_1$=0 V is obtained for the first, i.e., the lowermost, stop position. A voltage $U_2$=3.33 V is obtained for the second stop position, a voltage $U_3$=6.67 V is obtained for the third stop position, and a voltage $U_4$=10 V is obtained for the fourth, i.e., the uppermost, stop position. These voltages $U_1$ to $U_4$ are the reference values for the correct stop positions, by which the travel of the elevator car 2 can be regulated. Since the given voltage $U_{Pos}$ during travel can be measured as an actual value, precise travel regulation is possible. The control offset must go to zero by the time the car comes to a stop. In this way, it is also possible to eliminate the use of so-called "crawling speed", i.e., the frequently used reduced-speed approach to a stop position. The elevator car 2 can thus be moved directly to the stop position at a continuously decreasing speed until the end, which is called direct approach. This offers the advantage of reduced travel time.

If the supply points, i.e., the upper reference point 12 and the lower reference point 13, do not coincide with the uppermost and lowermost stop positions, but rather the upper reference point 12 lies above the uppermost stop position, and the lower reference point 13 lies below the lowermost stop position, then different values for the voltages correlated with the stop positions are obtained for the uppermost and lowermost stop positions. Operation with direct approach is also possible here. For example, the voltage $U_1$ for the lowermost stop position may be 0.2 V, and the voltage for the uppermost stop position may be 9.8 V. In this case, the voltages for the other two stop positions, assuming equal distances between the stop positions, have the values $U_2$=3.40 V and $U_3$=6.6 V.

Figure 3:
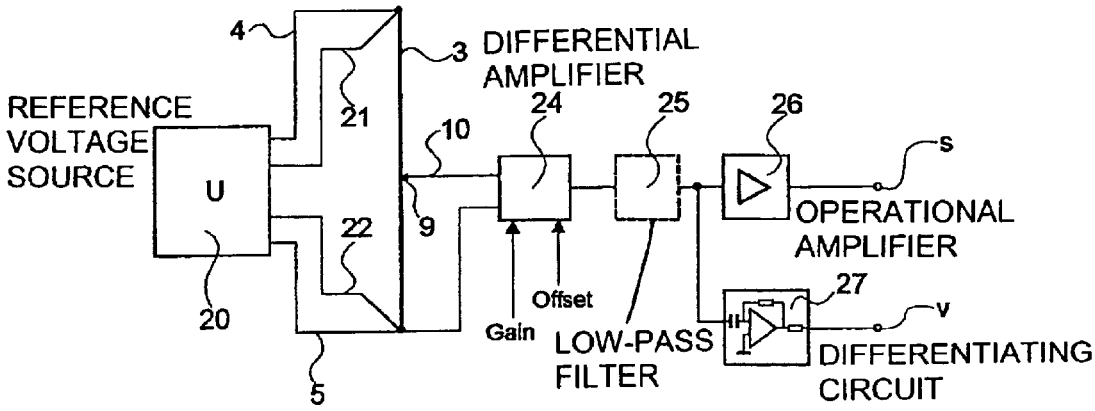
FIG. 3 shows an electric circuit.

FIG. 3 shows a first embodiment of an electric circuit. The resistance wire 3 is connected with a reference voltage source 20 by the first electric connecting lead 4 and the second electric connecting lead 5. In addition, a first sensing line 21 and a second sensing line 22 run from the reference voltage source 20 to reference point 12 and reference point 13, respectively. This well-known method makes it possible to compensate the resistance of the connecting leads 4, 5, which improves the precision of the measurements. The accuracy that can be achieved during approaches to stop positions is correspondingly improved in this way. The reference voltage source 20 is very precise.

The measuring line 10 runs from the contact 9 to the first input of a differential amplifier 24. The GND signal of the second connecting lead 5 is supplied to the second input. It is advantageous for the differential amplifier 24 to have additional inputs, to which signals can be supplied to make it possible, as is already well known, to adjust the signal amplification, i.e., gain, on the one hand, and compensate the offset voltage, i.e., offset, on the other hand. Electrical errors can be minimized or even completely eliminated in this way. The output of the differential amplifier 24 is connected to a low-pass filter 25 that may be present. The output of the low-pass filter 25 is routed, on the one hand, to an operational amplifier 26, at whose output a signal that is correlated with the position s of the elevator car 2 can be picked up, and, on the other hand, to a differentiating circuit 27, at whose output a signal that is correlated with the velocity v of the elevator car 2 can be picked up. If a low-pass filter 25 is not used, the output of the differential amplifier 24 is routed directly to the inputs of the operational amplifier 26 and differentiating circuit 27.

The reference voltage source 20, the differential amplifier 24, the possibly present low-pass filter 25, the operational amplifier 26, and the differentiating circuit 27 are, for example, components of the automatic control and regulation unit 7 shown in FIG. 1, such that the differential amplifier 24, the possibly present low-pass filter 25, the operational amplifier 26, and the differentiating circuit 27 are components of the position-sensing unit 6 (FIG. 1) contained in the automatic control and regulation unit 7.

Figure 4:
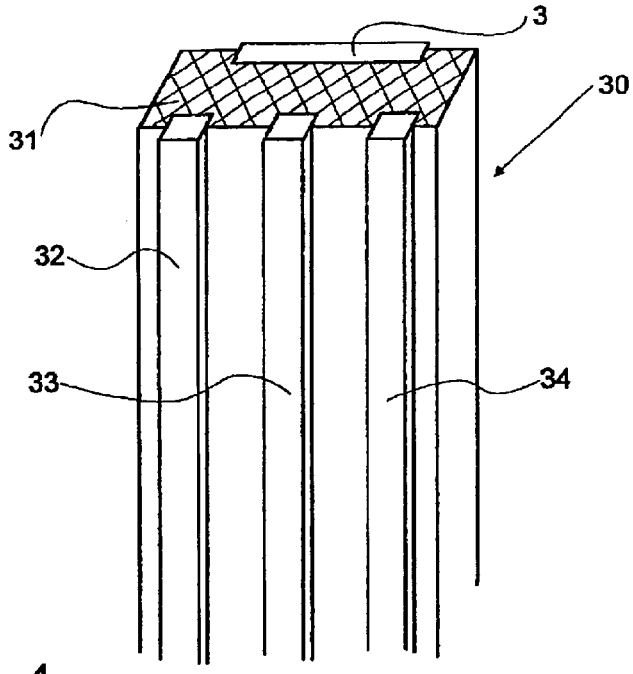
FIG. 4 shows a cable unit.

FIG. 4 shows an embodiment of a cable unit 30 in a cutaway oblique view, which is equipped with the resistance wire 3 and other conductors. The base of the cable unit 30 is a plastic support 31, on one side of which the resistance wire 3 is form-fitted to the plastic support 31. Three conductors are mounted on the opposite side, namely, a feed conductor 32, a sensing conductor 33, and a feedback conductor 34. For the sake of simplicity, the resistance wire 3 and the three conductors 32, 33, 34 are shown here as flat wires, but they may have any desired form. The arrangement of the conductors should be regarded merely as an example. Other embodiments are possible within the general scope of the idea of the invention. For example, the feed conductor 32 and the sensing conductor 33 may be embedded in the plastic support 31, i.e., they may be surrounded by insulating material.

Figure 5A:
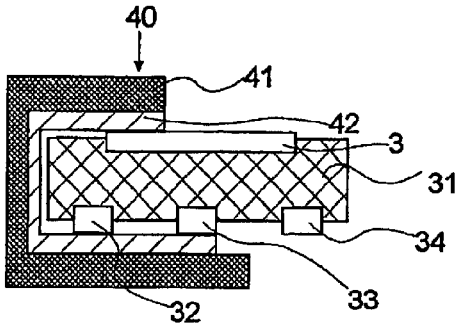
FIGS. 5*a* to 5*c* show connection points to this cable unit.
Figure 5B:
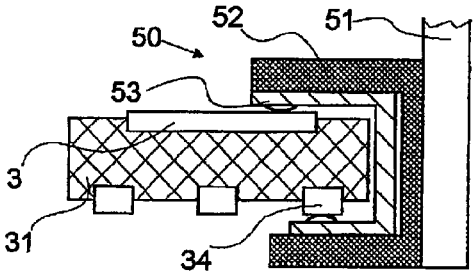
Figure 5C:
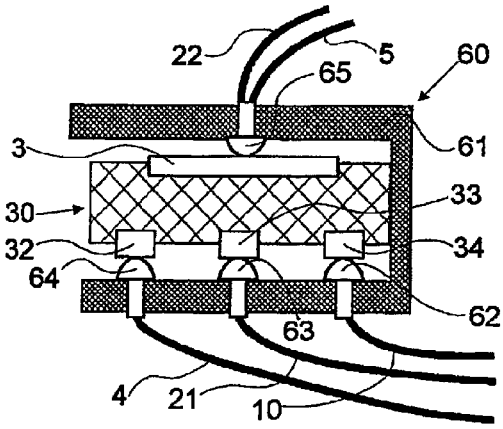

FIGS. 5*a* to 5*c* show how the cable unit 30 is connected. In FIG. 5*a*, the upper connection point 12 (FIG. 2) is shown schematically in a special embodiment. Here an upper connecting piece 40 is fastened to the cable unit 30 in a position on the cable unit 30 that corresponds to the uppermost position of the elevator car 2 (FIG. 1). The bridge 40 consists of a bracket 41 with an inserted electrically conductive web 42. The resistance wire 3, the feed conductor 32, and the sensing conductor 33 are electrically connected with one another by the web 42. It is advantageous for the mounting device 11 (FIG. 2) for the upper end of the cable unit 30 to be located directly above the connecting piece 40. However, the mounting device 11 and the connecting piece 40 may also be combined into a single component.

FIG. 5*b* is a schematic representation of a tapping unit 50, which is connected by a bracket 51 to the elevator car 2, which is not shown here (see FIG. 1). Therefore, as the elevator car 2 travels, the tapping unit 50 slides along the cable unit 30. The tapping unit 50 consists of a mounting fixture 52 and a spring bracket 53 supported in the mounting fixture 52. The spring bracket 53 is shaped in such a way that it creates a permanent connection between the resistance wire 3 and the feedback conductor 34, so that, at any given location, the potential present at the feedback conductor 34 is the same as the potential that prevails at the contact point of the spring bracket 53 on the resistance wire 3. This is the potential that is correlated with the position of the elevator car 2 (FIG. 1) at any given time.

FIG. 5*c* shows a connection unit 60 with which the lower connection point 13 (FIG. 2) is formed in a special embodiment. The connection unit 60 again surrounds the cable unit 30 and is fastened to it. The connection unit 60 consists of a support 61, in which four contacts are embedded. The first of these contacts is a position signal contact 62, which is in contact with the feedback conductor 34. As was explained in connection with FIG. 5*b*, the feedback conductor 34 has the potential that corresponds to the position of the elevator car 2 (FIG. 1) at any given time, i.e., the voltage $U_{Pos}$. Therefore, the measuring line 10 described earlier in connection with FIG. 1 is connected to the position signal contact 62 and leads to the position-sensing unit 6 of the automatic control and regulation unit 7 (FIG. 1). The advantageous solution resulting from FIGS. 5*b* and 5*c* avoids a separate cable connection of the elevator car 2 to the position-sensing unit 6, as would be necessary according to the drawing in FIG. 1.

The connection unit 60 also contains a sensing positive contact 63, which is in electrical contact with the sensing conductor 33. The first sensing line 21 described earlier in connection with FIG. 3 is connected to the sensing positive contact 63. A power supply voltage contact 64 installed in the connection unit 60 creates electrical contact with the feed conductor 32. The first electric connecting lead 4 known from FIGS. 1 and 3 is connected to it and supplies the operating voltage $+U_B$. Furthermore, the connection unit 60 contains a GND contact 65, which creates electrical contact with the resistance wire 3. The GND contact 65 is connected to the second electric connecting lead 5, which carries the reference voltage GND associated with the operating voltage $+U_B$, as well as to the second sensing line 22 shown in FIG. 3.

If, as was mentioned earlier, the feed conductor 32 and the sensing conductor 33 are embedded in the plastic support 31, the insulation must be removed in the region of the connecting piece 40 and the connection unit 60.

This embodiment of the cable unit 30, in conjunction with the upper connecting piece 40 in accordance with FIG. 5*a*, the tapping unit 50, and the connection unit 60, results in the advantageous situation that all of the connections to the resistance wire 3 that are shown in FIGS. 1, 2, and 3 are present in the connection unit 60. This allows simple wiring and thus significantly reduces the assembly work.

Since the cable unit 30 has a plastic support 31, and the plastic can undergo thermal expansion that is not negligible, a problem can arise if the temperature in the elevator shaft 1 is subject to fluctuation. To absorb the thermally produced change in length of the cable unit 30, it is advantageous to anchor the cable unit 30 permanently at the upper end of the travel range of the elevator car 2 (FIG. 1), and to provide a flexible mount for the lower end of the cable unit 30. It would also be possible to permanently mount the lower end of the cable unit 30 and to provide a flexible mount for the upper end. It is advantageous for the connection unit 60 to be installed at the lower end of the cable unit 30, because the other elevator system equipment, such as a control box and the drive machinery, are also usually located at the bottom of the building.

Figure 6:
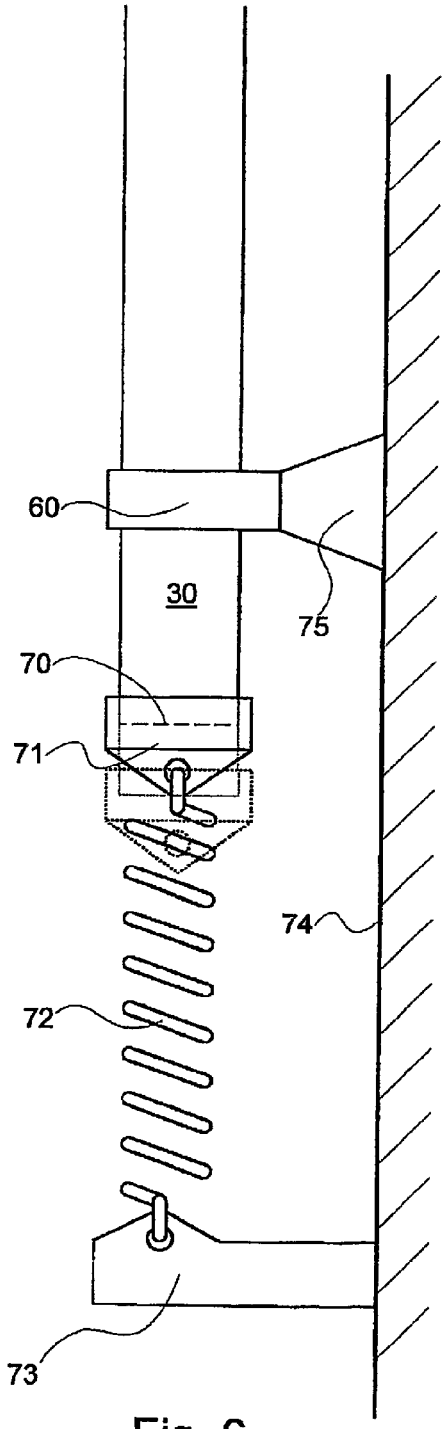
FIG. 6 shows a mounting device.

FIG. 6 is a schematic representation of a spring mounting. The lower end 70 of the cable unit is connected to a cable clamp assembly 71, which is attached to one end of an extension spring 72, whose other end is attached to a mounting device 73, which is connected to a wall 74 or the floor of the elevator shaft 1 by positive locking. The situation at a certain temperature is shown with solid lines. If the temperature is significantly higher, the cable unit 30 lengthens accordingly, but it remains under tension due to the action of the extension spring 72. However, the lower end 70 with the cable bearer 71 is then located in a lower position, which is shown in FIG. 6 with broken lines.

To ensure that these temperature-related changes in the length of a cable unit 30 do not lead to errors in the determination of the position of the elevator car 2 (FIG. 1), it is advantageous to fix the connection unit 60 in its position relative to the elevator shaft 1 (FIG. 1) by rigidly connecting the connection unit 60 to the wall 74 by means of a mounting element 75. This guarantees that the distance between the bridge 40, which defines the uppermost position of the elevator car 2 (FIG. 1), and the connection unit 60 remains constant. The connection unit 60 is thus fixed on the elevator shaft 1 (FIG. 1) and not on the cable unit 30. The contacts 62, 63, 64, and 65 slide along the corresponding conductors, when the entire length of the cable unit 30 changes as a result of changes in temperature. This guarantees accuracy of measurement at all temperatures.

Figure 7:
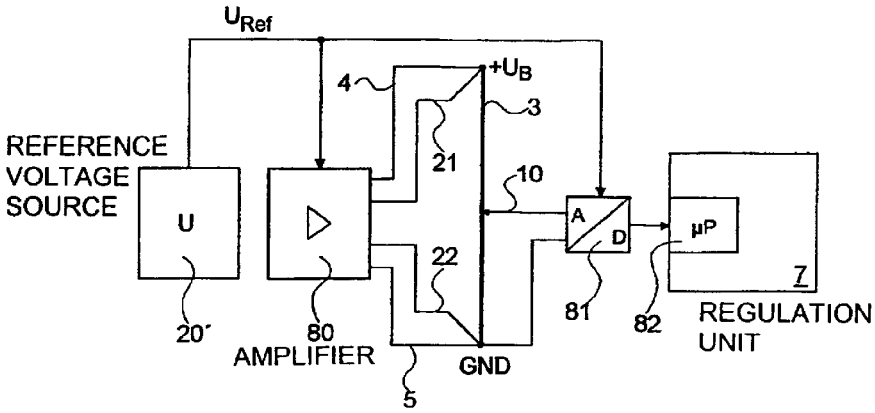
FIG. 7 shows another electric circuit.

FIG. 7 shows a second embodiment of an electric circuit. As in the embodiment shown in FIG. 3, a reference voltage source is also present here. However, it is labeled with reference number 20' here, because although it is functionally similar, it is not the immediate source of the voltage supply for the resistance wire 3. The voltage supply for the resistance wire 3 is provided by the amplifier 80 in this case, which is controlled by the reference voltage source 20'. The amplifier 80 is connected with the resistance wire 3 by the first electric connecting lead 4 and the second electric connecting lead 5 as well as by the first sensing line 21 and the second sensing line 22.

An analog-to-digital converter 81 is connected to the measuring line 10 in this case. Like the amplifier 80, the analog-to-digital converter 81 is operated on the reference voltage source 20'. This has the significant advantage that the reference voltage source 20', unlike the reference voltage source 20 (FIG. 3), does not have to be extremely precise. If the voltage of the reference voltage source 20' changes, this does not result in a measuring error in the position determination, because the amplifier 80 and the analog-to-digital converter 81 are connected to the same voltage source. Therefore, the requirements placed on the reference voltage source 20' are not as great. The analog-to-digital converter 81 produces a digital signal at its output that corresponds to the position of the elevator car 2 (FIG. 1). This signal is fed to a microprocessor 82, which is part of the automatic control and regulation unit 7 and contains the functionality of the position-sensing unit 6 (FIG. 1). The microprocessor 82 processes the digital signal of the analog-to-digital converter 81 in such a way that it determines the position s and the velocity v of the elevator car 1. Therefore, some of the components shown in FIG. 3 are not needed, namely, the differential amplifier 24, with the ability to adjust the signal amplification (gain) and the offset voltage (offset), the operational amplifier 26, and the differentiating circuit 27. Since both the amplifier 80 and the analog-to-digital converter 81 are controlled by the reference voltage source 20', the operating voltage $+U_B$ at the resistance wire 3 also depends on the reference voltage $U_{Ref}$ of the reference voltage source 20'. Therefore, changes in the reference voltage $U_{Ref}$ do not cause any measuring errors.

It is advantageous to combine the analog-to-digital converter 81 and possibly the reference voltage source 20' and the amplifier with the connection unit 60 to form a single assembly unit. This reduces the assembly work.

What is claimed is:

1. An apparatus for determining the position of an elevator car in an elevator shaft, said apparatus comprising:

a resistance wire installed vertically in an elevator shaft, said wire having a first end and a second end;

means for applying an operating voltage to said first end and a reference voltage to said second end;

a voltage tap installed on said elevator car, said voltage tap having a contact which rides on said resistance wire between said ends; and a position sensing unit connected to said voltage tap by a measuring line.

2. An apparatus of claim 1, wherein said means for applying an operating voltage comprises a reference voltage source connected to said first end by a first electric connecting lead and a first sensing line, and connected to said second end by a second electric connecting lead and a second sensing line.

3. An apparatus of claim 2, wherein said position sensing unit comprises a differential amplifier connected to said voltage tap by said measuring line, an operational amplifier that determines the position of the elevator car, and a differentiating circuit that determines a velocity of the elevator.

4. An apparatus of claim 2, wherein said position sensing unit comprises an analog to digital converter and a microprocessor.

5. An apparatus of claim 4, wherein said analog to digital converter is connected said reference voltage source, said apparatus further comprising an amplifier connected to said reference voltage source and providing said operating voltage to said resistance wire.

6. An apparatus of claim 2, further comprising:

a cable unit containing said resistance wire, a feed conductor, a sensing conductor, and a feedback conductor;

an upper connecting piece which electrically connects said resistance wire, said feed conductor, and said sensing conductor at an upper connection point; and a connection unit which supports said cable unit at a lower connection point, said connection unit connecting the feed conductor to the reference voltage source by the first electric connecting lead, connecting the resistance wire to the reference voltage source by the second electric connecting lead and the second sensing line, connecting the sensing conductor to the first sensing line, and connecting the feedback conductor to the measuring line.

7. An apparatus of claim 6, wherein said cable unit is fixedly anchored at said first end and resiliently and resiliently mounted at said second end.

8. An apparatus of claim 7, wherein said connection unit is fixedly anchored to said wall of said elevator shaft.

* * * * *